United States Patent [19]

LeBlanc et al.

[11] Patent Number: 4,573,397

[45] Date of Patent: Mar. 4, 1986

[54] TURRET CONTROL SYSTEM

[75] Inventors: James C. LeBlanc; Richard S. LeBlanc, both of Mt. Clemens, Mich.

[73] Assignee: General Motors Corporation, Detroit, Mich.

[21] Appl. No.: 654,712

[22] Filed: Sep. 26, 1984

Related U.S. Application Data

[63] Continuation of Ser. No. 437,856, Oct. 29, 1982, abandoned.

[51] Int. Cl.[4] ..... F41F 21/08

[52] U.S. Cl. ..... 89/41.12; 60/386; 91/445

[58] Field of Search ..... 60/386, 413, 416; 89/36.13, 41.12; 91/5, 445

[56] References Cited

U.S. PATENT DOCUMENTS

| | | | |
|---|---|---|---|
| 2,388,010 | 10/1945 | Pohl | 89/36 K |
| 3,065,674 | 11/1962 | Hereth et al. | 89/41 H |
| 3,065,739 | 11/1962 | Boroson | 91/445 |
| 3,541,927 | 11/1970 | Iijima | 91/445 X |
| 3,712,180 | 1/1973 | Pieper | 91/445 X |
| 3,943,825 | 3/1976 | Bianchetta et al. | 91/445 X |
| 4,158,324 | 6/1979 | Tidemalm et al. | 89/41 H |
| 4,209,987 | 7/1980 | Kononov et al. | 60/413 |

*Primary Examiner*—Stephen C. Bentley
*Attorney, Agent, or Firm*—Edward J. Biskup

[57] ABSTRACT

The disclosure relates to a control system for actuating a turret carrying a weapons system in an armored vehicle. An electrically actuated hydraulic system moves the weapons system in elevation and azimuth directions in driving the system toward a target. A manual pump backup is provided to effect movement in elevation when the automatic system is disengaged. A supercharger reservoir delivers makeup fluid to the pump under pressure to prevent cavitation. A variable capacity hydraulic motor is employed to drive the turret through the azimuth. Features described include various subsystems as well as the entire system.

4 Claims, 2 Drawing Figures

TURRET CONTROL SYSTEM

This is a continuation of co-pending application Ser. No. 437,856 filed Oct. 29, 1982, now abandoned.

BACKGROUND AND DISCUSSION OF THE INVENTION

Particularly in light armored vehicles a number of systems have been employed to rotate the turret assembly carrying a weapon through an arc and to elevate and depress the weapon in a plane substantially perpendicular to that of rotation. In other words, the weapon or weapons system is controlled both in the azimuth and the elevation so that it can be moved quickly to the target to be fired upon. Electrically actuated hydraulic systems used before have been complex and often lacking an efficient backup system in the eventuality that the electrical system failed. Particularly with regard to the elevation of the weapon, systems have been deficient in compensating for the weight of the weapon acting against other control mechanisms during weapons movement.

The invention described in detail hereinafter overcomes many of the problems of acutating systems discussed above. A feature of the invention is the simplicity and efficiency of the unique arrangement of the components which comprise the system as a whole. Also, the integration of a manual pump system with a hydraulic elevation piston-cylinder arrangement connected to a supercharger maintains proper pressure within the manual pump and avoids cavitation when the manual pump is placed in operation. An advantage of this system is the ability to maintain this supercharger at a pressure above atmosphere and to provide makeup fluid to compensate for certain operations of the hydraulic piston-cylinder arrangement for elevating and depressing the weapon.

As the piston rod displaces volume within the hydraulic elevation cylinder, during certain movements of the piston within the cylinder, more fluid will be flowing into the cylinder than will be flowing out. Consequently, it is necessary to make up this return fluid to the manual pump so that it can operate properly. This is accomplished by having the supercharger system incorporated as described.

The weapon or cannon operated by the hydraulic piston-cylinder arrangement and connected to the piston is of a substantial weight when compared to the forces in the cylinder applied to oppose gravitational forces. When the gun is lowered, the fluid in the upper portion of the cylinder will tend to be forced out under the weight of the cannon driving the piston rod upwardly. Consequently, without some control of the fluid exiting the system the cannon would typically drop faster than a desired speed for controlling movement of the weapon system to the target in an orderly manner. To compensate for this problem a one-way flow control valve is incorporated in the system to impede flow out of the elevation piston-cylinder apparatus when the weapon is being depressed. The flow control valve on the other hand operates to allow flow into the cylinder at a greater rate when the gun is being raised since the weight of the gun must be overcome by the pressure of the system to force the fluid into the cylinder.

In addition there is provided a cylinder lock valve downstream of an elevation servo-valve controlling the flow of hydraulic fluid to the elevation cylinder. The lock valve operates to lock the weapon in a position should the system become depressurized for whatever reason. The lock valve is pressure operated such that as long as there is upstream pressure the valve will remain open to allow the cylinder to be pressurized. But once this upstream pressure ceases, the lock valve will automatically close preventing any further movement of hydraulic fluid toward or away from the hydraulic elevation cylinder thus locking the piston in place.

The above has been a description of some features of the invention as distinguished from some disadvantages which had accompanied other systems of the past. The following is a more detailed discussion of the preferred embodiments from which other advantages of applicants' invention will be perceived.

DETAILED DESCRIPTION OF THE PREFERRED EMBODIMENT

Figure 1:
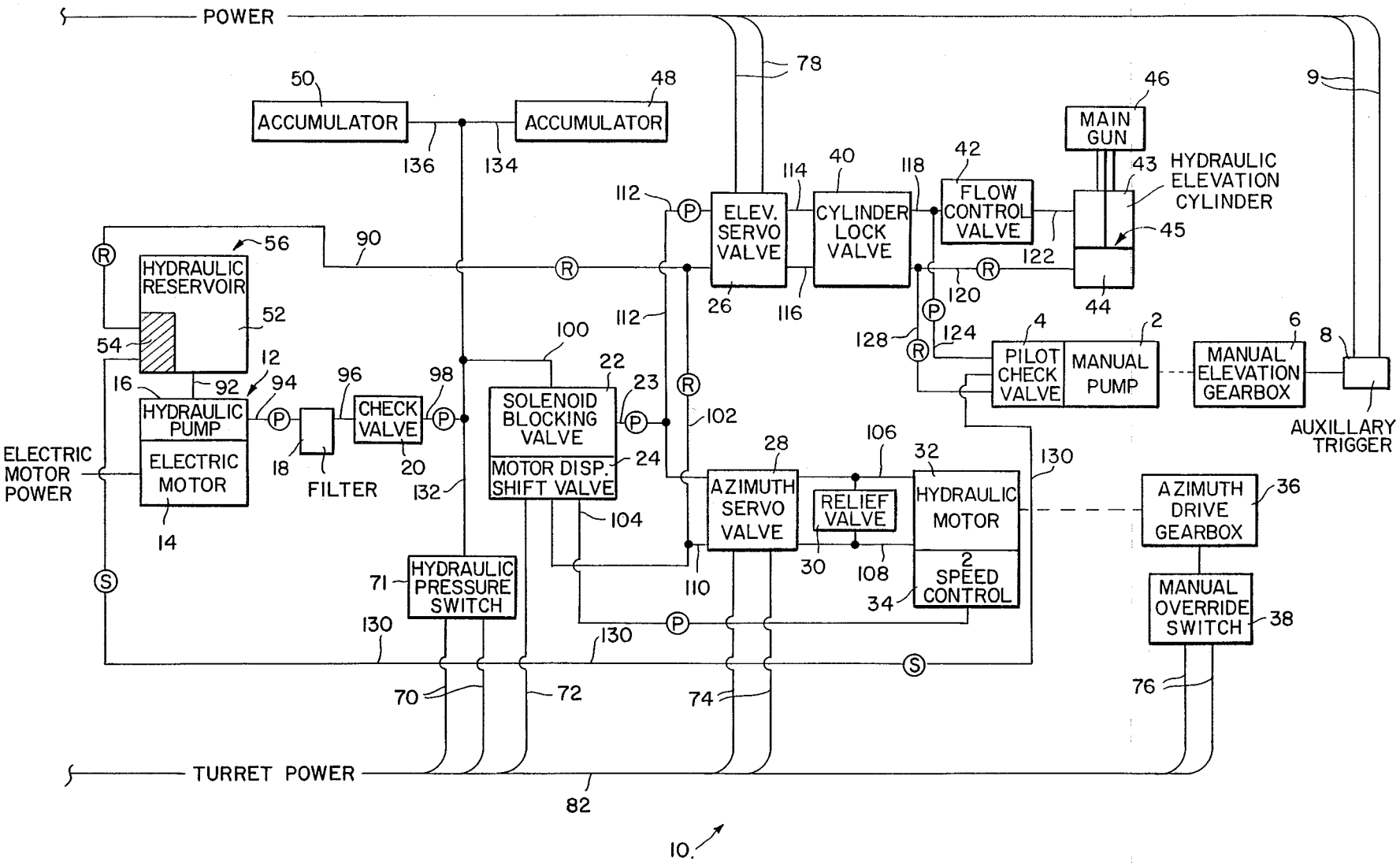
FIG. 1 is a schematic view of a system diagram of the hydraulic system of the invention.

Referring to FIG. 1 there is shown a system 10 for controlling the azimth and elevation of a weapon system to be carried on a light armored vehicle. The system includes a pump apparatus 12 for pressurizing hydraulic fluid drawn from a hydraulic reservoir 56 for delivery to a pair of accumulators 48,50. The fluid is maintained at high pressure between about 1000 to 1500 psi in the accumulators for use in the remainder of the system for actuation. The pump apparatus includes a hydraulic pump 16 which is driven by electric motor 14 to draw hydraulic fluid from reservoir chamber 52 and deliver it through filter 18, to a check valve 20, ultimately to line 132 for delivery to the accumulators 48 and 50. A hydraulic pressure switch 71 is incorporated to deactivate the electric motor once the proper pressure has been achieved in the accumulators.

A solenoid blocking valve 22 is arranged downstream of the accumulators 48,50 via line 100 to control delivery of high pressure hydraulic fluid from accumulators 48,50 to other elements of the system for moving the weapon systems in the azimuth and elevation directions. Solenoid blocking valve 22 is actuated via line 72 by an electrical signal from a joy stick or other actuator within the armored vehicle. When solenoid blocking valve 22 is actuated to the open position hydraulic fluid under pressure is delivered through line 23 to the elevation servo valve 26 and azimuth servo valve 28 through the line 112. Elevation servo valve 26 is actuated by electrical power source through line 78 to deliver pressurized fluid through line 114 to cylinder lock valve 40. When under pressure, cylinder lock valve 40 operates to allow pressurized fluid through line 118 to control valve 42 to side of a piston-cylinder arrangement for actuating the weapons system.

Piston-cylinder arrangement for elevating and depressing the weapon system is referred to herein as hydraulic elevation cylinder 45. The weapons system includes a main gun 46 shown schematically connected to a piston within cylinder 45. The piston divides the cylinder 45 into a rear chamber 44 and a front chamber 43 of variable volume depending on piston displacement. The piston rod extends through front chamber 43 to connect the piston with main gun 46. As gun 46 is being raised by the action of hydraulic fluid under pressure into the front chamber 43 of hydraulic cylinder 45 through a port via line 122, fluid in rear chamber 44 of cylinder 45 is forced out from a cylinder port via return line 120 through the cylinder lock valve 40 and elevation servo valve 26 ultimately to lines 90 and 102 where it is returned to the motor displacement shift valve 24 and the hydraulic reservoir 56.

On the other hand, if it is desired to lower main gun 46, the piston must be forced upwardly requiring the input of pressurized hydraulic fluid into the chamber 44 and the displacement of fluid in chamber 43. This is accomplished by shifting the elevation servo valve 26 via electric signal in lines 78 to a position where pressurized fluid is delivered through lines 116, cylinder lock valve 40, line 120 to chamber 44 thus forcing the piston upwardly, lowering the main gun 46. Return fluid is then forced out of the chamber 43 through line 122 and flow control valve 42. Since flow control valve 42 limits the flow of fluid out of elevation cylinder 43 the movement of the gun downwardly is restricted to a certain extent by the action of this valve.

The hydraulic fluid controlled by flow control valve 42 passes through line 118 and cylinder lock valve 40 where it is then delivered to line 116 and ultimately through elevation servo valve 26 to line 90 where it is returned to the hydraulic reservoir 56. When the elevation servo valve 26 is closed for whatever reason by the actuation or deactuation of a line 78, pressurized fluid ceases on the upstream side of lock valve 40 through either line 116 or 114, and the cylinder lock valve 40 will move to a locked position where fluid is not permitted to flow in either direction. This locks the elevation of main gun 46 in the position it happens to have attained at the time elevation servo valve 26 is moved to a closed position. In this locked position pilot check valve 4 of the manual pump 2 is moved to an open position placing into operation the manual pump 2 for moving the main gun in elevation by an alternate backup system.

As can be seen from FIG. 1, pilot check valve 4 of manual pump 2 is connected to lines 122 through lines 124 and the return line 128 to line 120 to either side of the piston within cylinder 45.

The manual pump 2 is further connected with line 130 to a supercharger reservoir 54 which provides makeup fluid at a raised pressure above atmosphere to provide makeup fluid for manual pump 2 when it is pumping into the rear chamber 44. This same line 130 provides a return line to the hydraulic reservoir 56.

Figure 2:
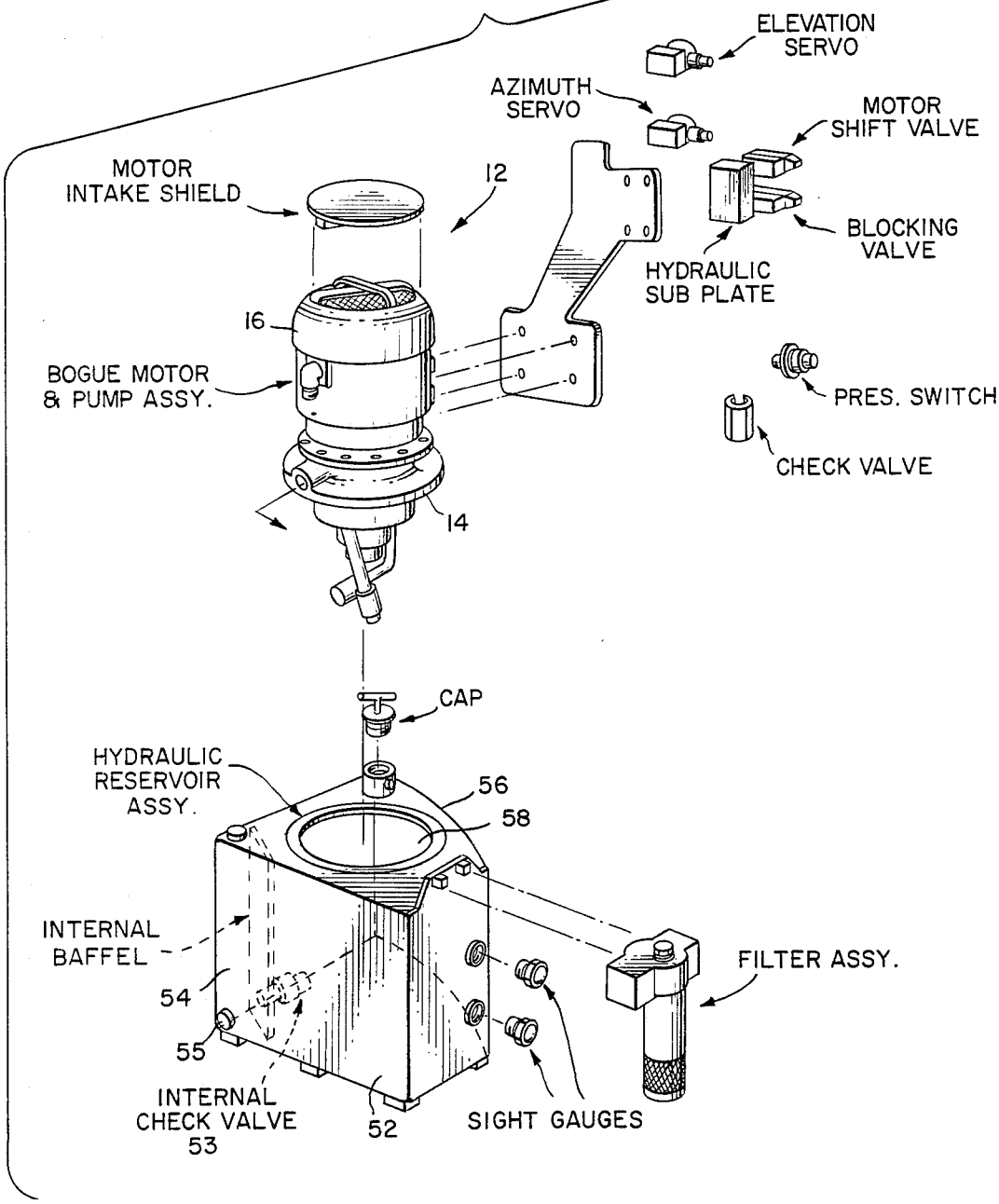
FIG. 2 is a perspective view of the hydraulic reservoir and related apparatus incorporated in a system of the invention.

Specifically, as can be seen in FIG. 2, hydraulic reservoir 56 includes two cavities; a main reservoir 52 for receiving and holding hydraulic fluid for delivery to the hydraulic pump 16 at atmospheric pressure and a supercharger reservoir chamber 54 maintained at 5 psi for delivering a higher pressure hydraulic fluid to the manual pump 2 through pilot check valve 4. This same reservoir 54 acts as a return supercharger reservoir chamber for all return fluid through the system. It includes a 5 psi back pressure check valve 53 which permits the fluid once having reached 5 psi to be discharged into main reservoir 52 for delivery to hydraulic pump 16.

As can be seen from the FIG. 2, the hydraulic a reservoir 56 includes an opening 58 for receiving a portion of hydraulic pump 16 which draws fluid from the main reservoir 52 for pumping to other portions of the system. The opening 58 is circumscribed by a number of drilled and tapped holes which permit a flange on hydraulic pump 16 to be attached thereto. In the top portion of the hydraulic reservoir 56 there is provided a system return opening 57 for receiving spent fluid used in other portions of the system which is initially returned to the pressurized supercharger reservoir chamber 54. This chamber 54 further defines an outlet 55 connected to line 130 for delivering supercharged pressure ultimately to manual pump 2. A front portion of the hydraulic reservoir assembly 56 is adapted to be connected to the filter 18 and to provide sight gages for viewing the internal parts of the reservoir. Furthermore, a filling hole 60 is provided with a cap 61 which permits filling of the hydraulic reservoir 56 with hydraulic fluid for use in the system and closing the rest of the system with the cap once the filling has been completed.

It should be noted that manual pump 2 is operated through a manual elevation gear box 6 and includes auxillary trigger 8 ultimately connected to a firing mechanism for the gun. With this system, when the elevation servo valve 26 is moved to a closed position, operation of manual pump 2 permits pilot check valve 4 to open, movement of the gun in elevation, and firing of the gun by trigger 8.

The second portion of this system relates to movement about the weapon system through an arc to obtain the desired azimuth. Solenoid blocking valve 22 operates in the same manner as described above to deliver high pressure fluid through line 23 to line 112 to the azimuth servo valve 28. Return lines 110 and 102 are provided for the return of spent fluid from the system downstream of valve 28. The azimuth servo valve 28 is operated by electrical signals via lines 74 and 82 to move the azimuth servo valve 28 to the desired position. In the position shown, high pressure fluid is delivered through line 112 and 106 to a hydraulic motor 32. Under certain operations this hydraulic motor 32 will through the azimuth gear box drive the turret around an arc.

A two-speed control 34 is provided in connection with the motor 32 to drive it at a higher of lower speed depending on the desired operation of the system. For a higher speed an additional pressurized fluid will be required to operate two speed control 34 to actuate the smaller displacement of the motor. This is supplied by a line 104 from motor displacement shift valve 24 to control 34 which effects motor shift to ½ displacement where with the same volume or oil being supplied, it will turn twice as fast.

An override switch 38 is employed in conjunction with the azimuth drive gear box 36. Manual override switch is tripped when the azimuth drive is placed in a manual mode of operation. When tripped, switch 38 imparts an electrical signal through line 76 to close servo valve 28, disengaging the hydraulic motor such that the gear box can be driven manually without any load being placed on it by the hydraulic motor 32. Between the hydraulic motor 32 and azimuth servo valve 28 there is included, in parallel, a relief valve 30 between lines 106 and 108 to relieve the fluid should the pressure become too great.

With the system described above, a number of advantages are achieved over those problems which have characterized the prior art. These include a flow control mechanism for the gun to compensate for the weight of the gun during its downward movement from otherwise forcing fluid from the cylinder at an uncontrolled rate. Also, a supercharger system is employed which receives spent fluid at a relatively high pressure from the system and delivers that fluid at a higher pressure than atmosphere to the manual pump 2 for makeup fluid and avoiding cavitation of the pump.

The above has been a detailed description of the preferred embodiment. This should not be interpreted to detract from or avoid the full scope of applicants' invention which is defined in the claims hereafter and includes all equivalents.

We claim:

1. A system for controlling the elevation of a gun on a turret comprising:

a. pressure means for providing hydraulic fluid under pressure to said system;

b. a piston-cylinder means for elevating and lowering said gun, said piston-cylinder means having a rear chamber and a front chamber;

c. said piston-cylinder means including a cylinder having a piston arranged for reciprocal movement therein, one side of said piston being connected to a piston rod which is in turn connected to said gun for elevating and lowering said gun, and the other side exposed to said rear chamber;

d. said cylinder including a first inlet for communicating fluid to said rear chamber and a second inlet for communicating fluid to said front chamber;

e. a lock valve for locking said piston in position within said cylinder;

f. said lock valve having means for permitting fluid to flow into and from said cylinder while pressurized fluid is being delivered to said lock valve by said pressure means and preventing fluid flow to and from said cylinder when said pressure means ceases to deliver fluid under pressure to said lock valve for locking the piston in place;

g. said pressure means including a hydraulic reservoir having a main reservoir at atmospheric pressure for containing fluid for use in the system and pump means for drawing fluid from said main reservoir, pressurizing said fluid, and delivering said fluid under pressure to said piston-cylinder means;

h. manual pump means for delivering fluid under pressure to said piston-cylinder means, said manual pump means requiring makeup fluid in delivering fluid under pressure to at least one chamber of said piston-cylinder means; and i. a supercharger reservoir chamber located in said hydraulic reservoir adjacent said main reservoir for maintaining makeup fluid under pressure greater than atmosphere for delivery to said manual pump means so as to avoid cavitation when said manual pump means is placed in operation.

2. The system according to claim 1 wherein said supercharger reservoir chamber is connected to said main reservoir through a check valve to discharge fluid from said supercharger reservoir chamber into said main reservoir when the pressure in the supercharger reservoir chamber exceeds a selected value of the check valve.

3. The system according to claim 2 wherein said supercharger reservoir chamber is maintained at a pressure of about 5 pounds per square inch above atmosphere.

4. The system according to claim 3 wherein said supercharger reservoir chamber is connected to the return lines of the system so that all return fluid flows initially into said supercharger reservoir chamber and subsequently into said main reservoir when the pressure exceeds 5 pounds per square inch.

* * * * *